US005273446A

United States Patent [19]

Walkup

[11] Patent Number: 5,273,446

[45] Date of Patent: Nov. 28, 1993

[54] ZERO SEPARATION FORCE CONNECTOR WITH WIPING INSERTION

[75] Inventor: William B. Walkup, Huntington, Conn.

[73] Assignee: Burndy Corporation, Norwalk, Conn.

[21] Appl. No.: 970,098

[22] Filed: Nov. 2, 1992

[51] Int. Cl.[5] ..... H01R 13/00

[52] U.S. Cl. ..... 439/153

[58] Field of Search ..... 439/152-160, 439/180

[56] References Cited

U.S. PATENT DOCUMENTS

| | | | |
|---|---|---|---|
| 1,711,397 | 4/1929 | Rumble | 439/152 |
| 2,802,188 | 8/1957 | Badders | 339/17 |
| 3,149,896 | 9/1964 | Hall | 339/75 |
| 3,259,868 | 7/1966 | Irwin | 439/152 |
| 4,118,094 | 10/1978 | Key | 339/75 MP |
| 4,497,526 | 2/1985 | Myers | 339/17 LC |
| 4,560,216 | 12/1985 | Egawa | 339/12 V |
| 4,637,670 | 1/1987 | Coller et al. | 439/180 |
| 4,678,252 | 7/1987 | Moore | 439/62 |
| 4,813,879 | 3/1989 | Thenaisie et al. | 439/59 |
| 4,836,798 | 6/1989 | Carter | 439/268 |
| 4,889,499 | 12/1989 | Socher | 439/268 |
| 4,954,088 | 9/1990 | Fujizaki et al. | 439/73 |
| 4,990,095 | 2/1991 | Walkup | 439/152 |
| 5,002,499 | 3/1991 | Matsuoka | 439/342 |
| 5,037,321 | 8/1991 | Uratsuji et al. | 439/342 |

FOREIGN PATENT DOCUMENTS

| | | |
|---|---|---|
| WO84/00256 | 1/1984 | PCT Int'l Appl. . |
| 2083298A | 9/1981 | United Kingdom . |

*Primary Examiner*—Joseph H. McGlynn
*Attorney, Agent, or Firm*—Perman & Green

[57] ABSTRACT

An electrical connector assembly is provided having a first electrical connector and a second electrical connector. The second electrical connector has a housing with a connector receiving area and spring contacts. The first electrical connector has contacts located in the receiving area and contacting the spring contacts with suitable frictional forces and shapes at their areas of contact to provide substantially no resistance, by the contacts, to movement of the first connector out of the receiving area. This is accomplished due to geometric spring action force vector being substantially equal and opposite to the frictional force vector in the direction of movement of the first connector out of the receiving area. However, the frictional forces and spring action forces are additive during insertion of the first connector into the receiving area to thereby wipe the areas of contact between the contacts of the two connectors.

10 Claims, 2 Drawing Sheets

ZERO SEPARATION FORCE CONNECTOR WITH WIPING INSERTION

BACKGROUND OF THE INVENTION

1. Field of the Invention

The present invention relates to electrical connectors and, more particularly, to mating of connectors with wiping of contacts during connection and, allowing separation of the connectors with substantially zero resistance from their contacts.

2. Prior Art

Electrical connectors that have spring contacts and electrical connectors that can move these spring contacts for easier insertion of a printed circuit board or contacts of a second electrical connector are well known in the art as can be seen by review of U.S. Pat. Nos. Re: 29,223; 4,842,538; 4,705,338; 4,684,194; 4,636,021; 4,165,909; 4,159,861; 4,047,782; 3,899,234; 3,683,317; 3,553,630; 3,526,869; 5,037,321; 5,002,499; 4,889,499; 4,836,798; and, U.K. patent application 2083298A and PCT publication W084/00256. A problem exists with zero insertion force (ZIF) connectors and low insertion force connectors in that they do not provide a good contact wipe between contacts. As is known in the art, contact wipe between contacts allows for a good electrical connection by wiping away non-conductive material from between the contacts. A good contact wipe is provided by contacts such as disclosed in U.S. Pat. No. 4,934,961 that exert a uniform wiping action against a contact or contact trace. However, a problem exists with these types of constant pressure contacts in that they unnecessarily exert pressure during withdrawal or disconnection.

It is therefore an objective of the present invention to provide a new and improved electrical connector.

SUMMARY OF THE INVENTION

In accordance with one embodiment of the present invention an electrical connector assembly is provided comprising a first electrical connector and a second electrical connector. The first electrical connector has a first housing and first electrical contacts. The second electrical connector has a second housing and second electrical spring contacts. The second housing has a connector receiving area with the first electrical connector inserted, at least partially therein. The first and second contacts contact each other with suitable frictional forces an shapes at their areas of contact to provide substantially no net assistance or resistance to the movement of the first connector out of the second housing receiving area.

In accordance with another embodiment of the present invention an electrical connector assembly is provided comprising a first electrical connector, a second electrical connector, means for wiping, and means for substantially preventing separation forces. The first electrical connector has a first series of contact areas. The second electrical has a connector receiving area and a plurality of electrical spring contacts extending into the receiving area. The receiving area has at least a portion of the first electrical connector inserted therein, the spring contacts contacting the first electrical connector contact areas. The means for wiping can wipe the first electrical connector contact areas during insertion of the first electrical connector into the second electrical connector receiving area. The means for substantially preventing separation forces can substantially prevent separation forces of the first electrical connector from the second electrical connector due to contact between the spring contacts and the contact areas to thereby allow easy separation of the first electrical connector from the second electrical connector.

In accordance with one method of the present invention a method of manufacturing mating electrical connectors comprises steps of providing a first electrical connector housing; providing first electrical connector contacts having contact areas with first contact surfaces; mounting the first electrical connector contacts to the first housing to provide a first geometric shape at their contact surfaces; providing a second electrical connector housing with a connector receiving area for receiving a portion of the first electrical connector contacts and housing; providing second electrical connector spring contacts having second contact surfaces; and mounting the second electrical connector spring contacts to the second housing to thereby provide a second geometric shape at the second contact surfaces, the first and second contact surfaces contacting each other during insertion and removal of the first electrical connector in the receiving area such that, during insertion the friction, geometric and spring force interaction between the contact surfaces additively combined to wipe the contact surfaces and, during removal the frictional, geometric and spring force interaction between the contact surfaces subtractively combine to provide substantially no net forces in the direction of removal of the first electrical connector out of the receiving area.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
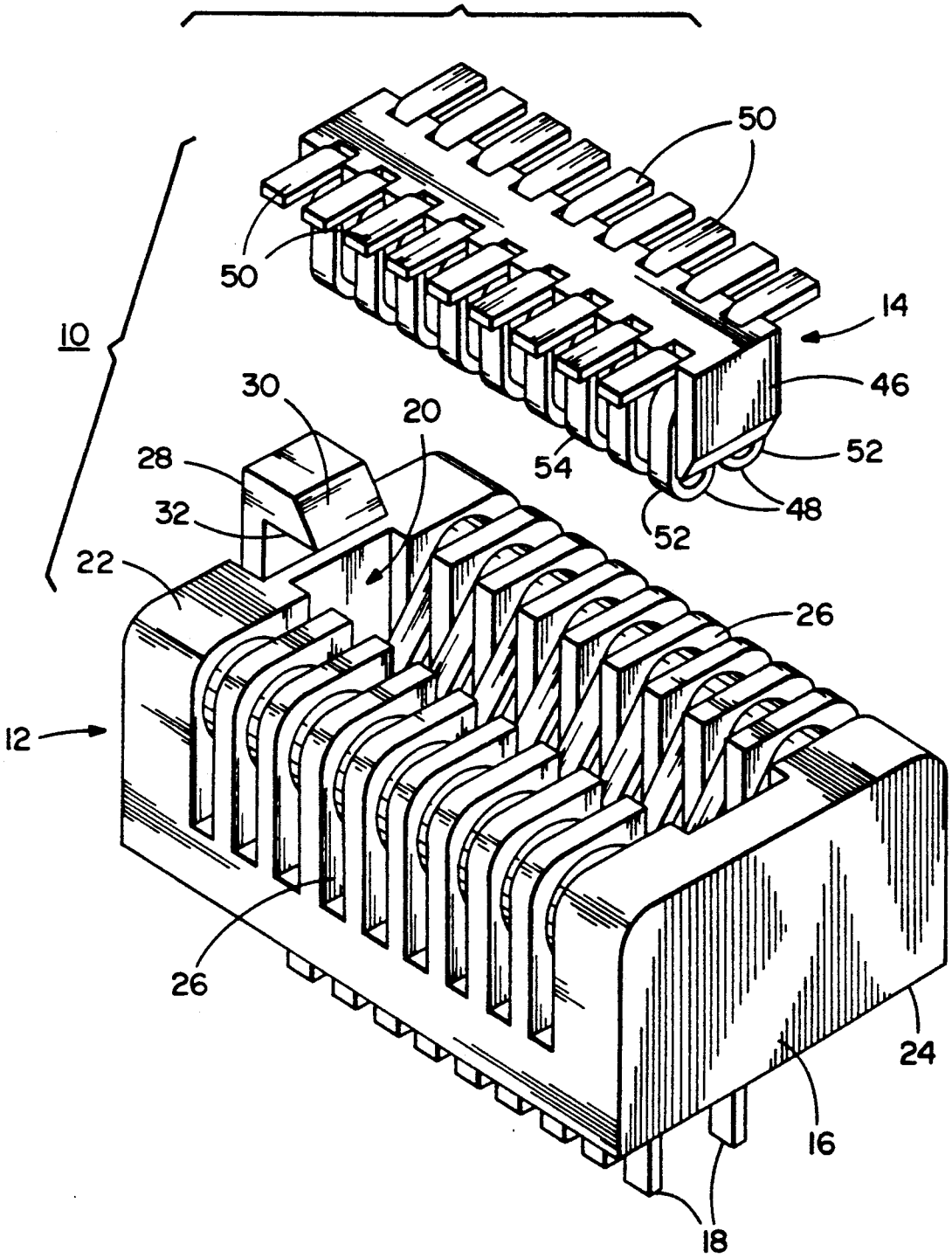
FIG. 1 is an exploded perspective view of an electrical connector assembly comprising features of the present invention.

Referring to FIG. 1, there is shown an exploded perspective view of an electrical connector assembly 10 incorporating features of the present invention. Although the present invention will be described with reference to the single embodiment shown in the drawings, it should be understood that the present invention may be embodied in many alternate forms of embodiment. In addition, any suitable size, shape or type of members or materials could be used.

Figure 2:
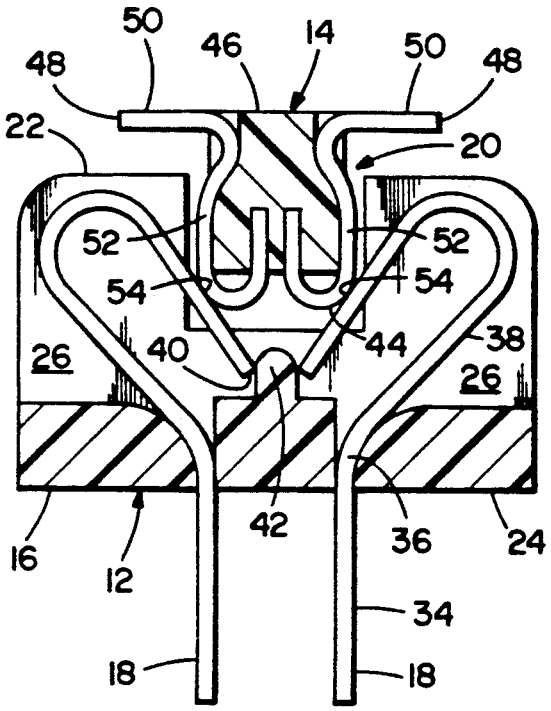
FIG. 2 is a schematic cross sectional view of the assembly shown in FIG. 1 at initial insertion of the male connector into the female connector.
Figure 3:
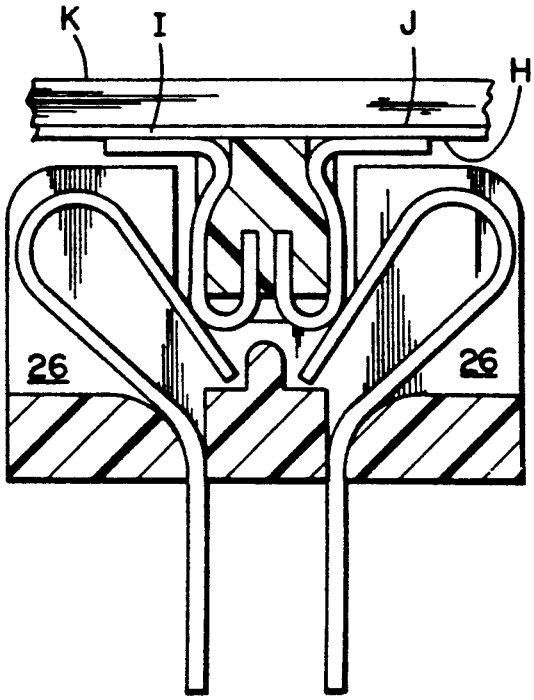
FIG. 3 is a schematic cross sectional view of the assembly as in FIG. 2 showing the male connector fully inserted into the female connector.

The assembly 10 generally includes a female electrical connector 12 and a male electrical connector 14. FIGS. 2 and 3 show the connectors 12, 14 at an initial connection stage and a final connection stage, respectively. The female connector 12 generally comprises a housing 16 and a plurality of spring contacts 18. The housing 16 is preferably comprised of a molded dielectric material, such as a molded plastic or polymer material. The housing 16 includes a center receiving area 20 extending through a top surface 22, a bottom surface 24 adapted to be positioned against an electrical component, such as a printed circuit board, a plurality of contact channels 26 aligned in two rows on opposite sides of the receiving area 20, and a latch 28 at one longitudinal end of the housing 16. The latch 28 is integrally formed with the rest of the housing 16 and extends above the top surface 22 in general cantilever fashion. However, in an alternate embodiment the latch 28 could be a separate member or members that are attached to the housing 16. The latch 28 is a snap-lock latch designed to deflect outwardly as the male connector 14 is being inserted into the female connector 12. The latch 28 has a cam surface 30 and a snap-lock ledge 32. The cam surface assists in wedging the latch outwards as the male connector 14 is being installed. The snap-lock ledge 32 is adapted to snap behind a portion of the male connector 14 at a final connection of the two connectors 12, 14 to thereby prevent the male connector 14 from being inadvertently disconnected from the female connector. Of course, any suitable means to prevent inadvertent disconnection of the two connectors 12, 14 could be provided.

The female connector contacts 18 are provided as spring contacts with each contact having a bottom section 34, a middle section 36, and a top section 38. In the embodiment shown, the contacts 18 are identical to each other, but different types of contacts could be provided. In the embodiment shown, the bottom section 34 is provided as a through-hole solder tail for insertion through a contact hole of a printed circuit board (not shown). However, an alternate embodiment could have surface mount solder tails or, any other suitable type of bottom section for connection to an electrical or electronic component. The middle section 36 is fixedly connected to the housing 16 in a hole in the bottom surface 24. The top section 38 has a general U-shape loop profile. The top section 38 has an end tip 40 that is spring loaded against a preload section 42 of the housing 16 in its home position; i.e.: when the male connector 14 is not connected to the female connector 12. The top section 38 has a contact area 44 that extends into the housing receiving area 20. When the male connector 14 is being inserted into the female connector 12, the top sections 38 are adapted to be deflected from their home positions shown in FIG. 2 to connection positions as shown in FIG. 3. These types of spring contacts that are stationarily mounted to a housing and have a section adapted to be contacted and deflected by a second connector are generally known as passively mounted spring contacts (as opposed to actively mounted spring contacts that are moved by a camming mechanism in a ZIF connector).

The male connector 14 generally comprises a housing 46 and a plurality of electrical contacts 48. In the embodiment shown, the contacts 48 are substantially stationarily mounted on the housing 46. However, spring contacts could alternatively be provided. The contacts 48 include a first end 50 adapted to be surface solder mounted to an electrical component and a second end 52 adapted to be inserted into the female connector receiving area 20. However, any suitable type of first end could be provided for connection to an electrical or electronic component. The second ends 52 have contact areas 54 for making electrical and mechanical contact with the contact areas 44 of the female contacts 18.

Figure 4:
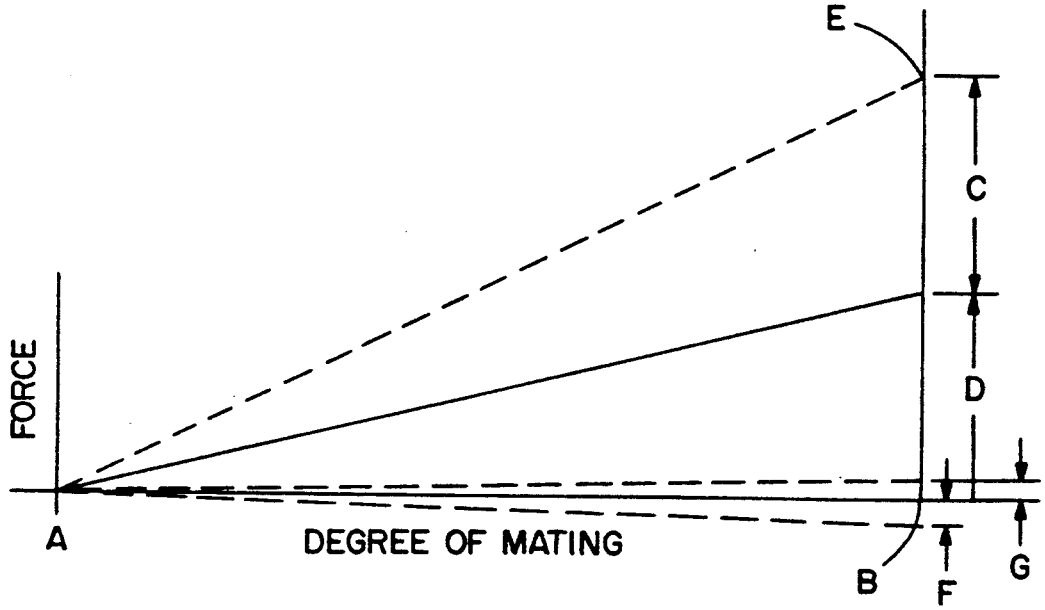
FIG. 4 is a graph showing geometric and frictional forces between contacts in the male and female connectors during insertion and removal of the male connector relative to the female connector.

Referring principally to FIGS. 2–4, mating and unmating of the connectors 12, 14 will be described. FIG. 2 shows the connectors 12, 14 at their initial mating positions; i.e.: where the male connector 14 is partially inserted into the receiving area 20 and the contacts 18 and 48 initially contact each other, generally illustrated as point A in FIG. 4. As the male connector 14 is further pushed into the female connector 12, the top sections 38 of the female contacts 18 are deflected back by the male contacts 48 until a final connection position is achieved as shown in FIG. 3, generally illustrated as point B in FIG. 4. The male connector housing 46 wedges the latch 28 (see FIG. 1) outward and then allows the latch 28 to snap behind the housing 46 at the final connection position. During this mating, the contacts 18 and 48 interact with each other; due generally to frictional interaction, geometric interaction, and spring forces. The frictional interaction includes the sliding of the contact surfaces 44 and 54 relative to each other. The geometric interaction is from the shape of the contact surfaces 44 and 54 relative to each other and the relative motion of the two connectors 12, 14. As seen in FIG. 4, the spring forces of the spring contacts 18 increase the geometric force element C and frictional force element D as the degree of mating increases from A to B. During mating, these geometric spring force element C and frictional force element D are additive to exert a total force between the contacts 18, 48 as illustrated by the top line E. These additive geometric and frictional forces combine to effectively wipe the contact surfaces 44 and 54 during mating to provide good electrical contact between the contacts 18,48.

Upon the two connectors 12, 14 being completely mated, the latch 28 snap-locks onto a portion of the male connector 14 to prevent unintentional disconnection of the connectors. Further insertion of the male connector 14 into the receiving area 20 is stopped. In the embodiment shown, the geometry and frictional characteristics of the contact surfaces 44, 54 are provided such that the force vectors between the contacts 18, 48 in a direction along the center axis of the receiving area 20 (referred to below as removal force vectors) are substantially equal, but opposite. In other words, the frictional removal force vector (exerted between the contacts) holding the male connector 14 in the receiving area 20 is opposite and equal to the geometric spring removal force vector (exerted by contacts 18 against contacts 48) pushing the male connector 14 out of the receiving area 20. This is true for all positions of the male connector in the receiving area 20 between points A and B in FIG. 4. The frictional removal force vector of the contact surfaces 44,54 is illustrated by F in FIG. 4. The geometric spring removal force vector of the contact surfaces 44, 54 is illustrated by G in FIG. 4. Because these two removal or separation force vectors are equal but opposite, they are subtractive from each other such that, during separation of the male connector 14 from the female connector 16, the net separation force (the force necessary to separate the male connector from the female connector based upon contact interaction) is substantially zero. Therefore, there is substantially no resistance to removal of the male connector from the female connector (other than first moving the latch 28 out of engagement with the housing 46). Of course, the geometry and/or index of friction on the surfaces 44, 54 could be adapted to provide a very slight positive or negative separation force if desired. The present invention is generally adapted to provide both wiping insertion of contacts when the connectors 12, 14 are mated to each other and, a substantially zero separation force between the connectors when they are being unmated. This type of connector is especially desirable where contact wiping is desired (most situations), but where it is undesired to have one or either of the connectors 12, 14 pulled in a direction away from the electrical component it is attached to. For example, in FIG. 3 the male connector 14 is shown surface solder mounted to a front face H of a flexible printed circuit board I. The rear face J of the flexible board I is supported by a surface of a member K for compressive loads. However, the flexible board I is not supported on the member K for tensile loads away from the member K. In this type of environment, tensile forces cannot be tolerated because they might damage the electrical connection of the connector 14 to the flexible board I because the flexible board would be moved by such tensile forces. The present invention allows substantially zero separation forces or, put another way, substantially zero force to separate the two connectors from each other. This substantially prevents pulling on the connector 14 and thereby prevents damage to the connection between the connector 14 and the flexible board I. Unlike the prior art ZIF connectors, the present invention has relatively few types of parts and does not require an active contact caming mechanism. The present invention is able to accomplish its features by means of totally passive connector assembly design.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector assembly comprising:

a first electrical connector having a first housing and first electrical contacts; and a second electrical connector having a second housing and second electrical spring contacts, the second housing having a connector receiving area with the first electrical connector inserted, at least partially, therein, the first and second contacts are suitably shaped, have suitable friction properties, and contact each other at suitable angles to provide substantially no net assistance or resistance to movement of the first connector out of the second housing receiving area.

2. An electrical connector assembly as in claim 1 wherein the second electrical spring contacts are located in two rows on opposite sides of the connector receiving area.

3. An electrical connector assembly as in claim 1 wherein the second electrical spring contacts are passively mounted spring contacts.

4. An electrical connector assembly as in claim 1 wherein the second electrical connector further comprises means for preventing unintentional disconnection of the first electrical connector from the second electrical connector.

5. An electrical connector assembly as in claim 4 wherein the means for preventing comprises a latch on the second housing adapted to engage the first housing.

6. An electrical connector assembly comprising:

a first electrical connector having a first series of contact areas;

a second electrical connector having a connector receiving area and a plurality of electrical spring contact extending into the receiving area, the receiving area having at least a portion of the first electrical connector inserted therein, the spring contacts contacting the first electrical connector contact areas;

means for wiping the first electrical connector contact areas during insertion of the first electrical connector into the second electrical connector receiving area; and means for substantially preventing any separation forces of the first electrical connector from the second electrical connector due to contact between the spring contacts and the contact areas to thereby allow easy separation of the first electrical connector from the second electrical connector.

7. An electrical connector assembly as in claim 6 wherein the spring contacts are located in two rows on opposite sides of the receiving area.

8. An electrical connector assembly as in claim 6 wherein the second electrical connector further comprises means for preventing unintentional disconnection of the first electrical connector from the second electrical connector.

9. An electrical connector assembly as in claim 8 wherein the means for preventing comprises a latch on the second electrical connector adapted to engage the first electrical connector.

10. A method of assembling an electrical connector assembly comprising steps of:

providing a first electrical connector housing:

providing first electrical connector contacts having contact areas with first contact surfaces;

mounting the first electrical connector contacts to the first housing to provide a first geometric shape at their contact surfaces;

providing a second electrical connector housing with a connector receiving area for receiving area for receiving a portion of the first electrical connector contacts and housing;

providing second electrical connector spring contacts having second contact surfaces;

mounting the second electrical connector spring contacts to the second housing to thereby provide a second geometric shape at the second contact surfaces; and mating the first and second contacts to each other, the first and second contact surfaces contacting each other during insertion and removal of the first electrical connector into and out of the receiving area such that, during insertion the frictional and geometric spring force interaction between the contact surfaces additively combine to wipe the contact surfaces and, upon removal the frictional and geometric spring force interaction between the contact surfaces subtractively combine to provide substantially no net assistance or resistance to removal of the first electrical connector out of the receiving area.

* * * * *

UNITED STATES PATENT AND TRADEMARK OFFICE

CERTIFICATE OF CORRECTION

PATENT NO. : 5,273,446

DATED : Nov. 28, 1993

INVENTOR(S) : William B. Walkup

It is certified that error appears in the above-identified patent and that said Letters Patent is hereby corrected as shown below:

On the title page, the Date of Patent [45] is --Dec. 28, 1993--.

Signed and Sealed this

Twenty-fourth Day of May, 1994

Bruce Lehman

*Attest:*

BRUCE LEHMAN

*Attesting Officer*

*Commissioner of Patents and Trademarks*